US010731332B1

(12) United States Patent
Iverson

(10) Patent No.: US 10,731,332 B1
(45) Date of Patent: Aug. 4, 2020

(54) COMPOSITE REINFORCED WOOD STUD FOR RESIDENTIAL AND COMMERCIAL BUILDINGS

(71) Applicant: Roosevelt Energy, LLC, Ham Lake, MN (US)

(72) Inventor: Brian Iverson, Ham Lake, MN (US)

(73) Assignee: Roosevelt Energy, LLC, Ham Lake, MN (US)

( * ) Notice: Subject to any disclaimer, the term of this patent is extended or adjusted under 35 U.S.C. 154(b) by 0 days.

(21) Appl. No.: 16/553,937

(22) Filed: Aug. 28, 2019

(51) Int. Cl.

| | |
|---|---|
| ***E04B 1/48*** | (2006.01) |
| ***E04B 1/26*** | (2006.01) |
| ***E04B 2/74*** | (2006.01) |
| *E04B 1/76* | (2006.01) |

(52) U.S. Cl.
CPC ..... *E04B 1/486* (2013.01); *E04B 1/26* (2013.01); *E04B 2/7412* (2013.01); *E04B 2001/2668* (2013.01); *E04B 2001/2696* (2013.01); *E04B 2001/7679* (2013.01)

(58) Field of Classification Search
CPC .... E04B 1/486; E04B 1/26; E04B 2001/2668; E04B 2001/2696; E04B 2/7412; E04B 2/707; E04B 2001/7679; E04C 3/16; E04C 3/29
See application file for complete search history.

(56) References Cited

U.S. PATENT DOCUMENTS

| | | | |
|---|---|---|---|
| 4,224,774 A | 9/1980 | Petersen | |
| 4,329,827 A * | 5/1982 | Thorn | E04B 7/22 52/790.1 |
| 4,578,909 A | 4/1986 | Henley et al. | |
| 4,578,914 A | 4/1986 | Staples | |
| 4,671,032 A | 6/1987 | Reynolds | |
| 4,720,948 A | 1/1988 | Henley et al. | |

(Continued)

FOREIGN PATENT DOCUMENTS

| | | |
|---|---|---|
| EP | 1705305 | 9/2006 |
| WO | 2014197972 | 12/2014 |
| WO | 2017011121 | 1/2017 |

OTHER PUBLICATIONS

Betzwood Associated PC, "5 Proven Ways to Optimize Framing," http://www.betzwood.com/2012/08/09/optimize-framing/, pp. 1-7.

(Continued)

*Primary Examiner* — Brian D Mattei
(74) *Attorney, Agent, or Firm* — Taft Stettinius & Hollister LLP; Gerald E. Helget

(57) ABSTRACT

A composite reinforced, optionally treated, wood stud for permanent wood foundations, above ground walls, floor joists, vertical support columns or headers for commercial and residential buildings has a first lumber section having a width and a depth and a second lumber section inverted with respect to the first lumber section having a width and a depth. A plurality of adjacent, aligned in a longitudinal row, mechanical fastening dowels angularly pass through the depth of the first lumber section and pass substantially through the width of the second lumber section. The dowels maintain a spatial relationship between the first and second lumber sections. The angularity of the dowels alternate vertically oppositely between adjacent dowels. From an end view, the dowel alternate in a cant relationship with adjacent dowels in a left and right manner.

40 Claims, 6 Drawing Sheets

(56) References Cited

U.S. PATENT DOCUMENTS

| | | | | |
|---|---|---|---|---|
| 4,852,310 | A | 8/1989 | Henley et al. | |
| 4,852,322 | A | 8/1989 | McDermid | |
| 4,937,122 | A | 6/1990 | Talbert | |
| 5,209,036 | A | 5/1993 | Cancilliari | |
| 5,609,006 | A | 3/1997 | Boyer | |
| 5,617,693 | A * | 4/1997 | Hefner | B27F 7/155 52/169.11 |
| 5,720,144 | A | 2/1998 | Knudson et al. | |
| 6,125,608 | A | 10/2000 | Charlson | |
| 7,574,837 | B2 | 8/2009 | Hagen, Jr. et al. | |
| 7,743,578 | B2 | 6/2010 | Edmondson | |
| 7,866,112 | B2 | 1/2011 | Edmondson | |
| 8,424,266 | B2 | 4/2013 | Edmondson | |
| 8,516,778 | B1 | 8/2013 | Wilkens | |
| 8,820,034 | B1 * | 9/2014 | Watts | E04C 3/16 52/404.1 |
| 9,103,113 | B2 | 8/2015 | Lockhart | |
| 9,604,428 | B2 * | 3/2017 | Walker | B29D 24/002 |
| 9,677,264 | B2 | 6/2017 | Iverson | |
| 2005/0050847 | A1 | 3/2005 | Lott | |
| 2005/0183367 | A1 | 8/2005 | Lembo | |
| 2006/0236652 | A1 | 10/2006 | Kismarton | |
| 2006/0254197 | A1 | 11/2006 | Tiberi et al. | |
| 2007/0130866 | A1 | 6/2007 | Lott | |
| 2007/0227095 | A1 | 10/2007 | Hubbe | |
| 2007/0283661 | A1 | 12/2007 | Daniels | |
| 2008/0245030 | A1 * | 10/2008 | Sieber | E04B 2/707 52/782.1 |
| 2010/0037542 | A1 | 2/2010 | Tiberi et al. | |
| 2010/0236172 | A1 | 9/2010 | Wirth | |
| 2010/0300037 | A1 * | 12/2010 | Turner | E04B 1/7654 52/782.1 |
| 2011/0107693 | A1 | 5/2011 | Haskell | |
| 2011/0239573 | A1 | 10/2011 | Lockhart | |
| 2012/0011793 | A1 | 1/2012 | Clark et al. | |
| 2012/0079776 | A1 * | 4/2012 | Beattie | E04B 1/26 52/90.1 |
| 2016/0289968 | A1 | 10/2016 | De Waal | |
| 2016/0356044 | A1 | 12/2016 | Thompson | |
| 2017/0247883 | A1 * | 8/2017 | Iverson | E04C 3/16 |

OTHER PUBLICATIONS

International Search Report and Written Opinion of PCT/US2016/037357, dated Sep. 8, 2016.

* cited by examiner

COMPOSITE REINFORCED WOOD STUD FOR RESIDENTIAL AND COMMERCIAL BUILDINGS

BACKGROUND OF THE INVENTION

Traditional basement walls are made from masonry materials, which typically include concrete or stone. The masonry materials may be cement blocks or poured concrete. A 2" foam insulation barrier is commonly placed on the outside of the foundation wall. A vapor and/or water barrier is thereafter placed over the insulation. Then the exterior space may be back filled with crushed stone, gravel or sand. The above ground back fill is then grade downwardly away from the building.

Masonry foundation walls are typically cold in the winter. Often the basement and crawl spaces have a musty odor as moisture can wick-up through the cement walls from below. Mildew, leakage and dampness are common and problematic for masonry foundation walls in buildings. Finishing the basement of a building with masonry walls is difficult and expensive. Egress doors, windows and escape exits require cutting and extraction of the masonry walls. Inside framed wood walls with insulation and a moisture barrier are also common, but expensive.

Pressure-treated wood was developed in the 1960s. Permanent foundation wood used in foundations is treated by steam-impregnating it with a chemical called CCA (chromated copper arsenate) at a concentration of at least 0.6 pounds of chemical per cubic foot of wood so that the chemical penetrates deep into the core of the wood. The copper part of the compound is toxic to fungus, mold and bacteria, while the arsenate is toxic to pests like carpenter ants and termites. Other pressure and non-pressure treatment options include: borates, amommiacal copper quantenary (ACQ) and pentachlorophenols. Other wood treatments are in development and expected to enter the marketplace in time. With these advances, it has become possible for wood to be used in foundation walls without being prohibitively vulnerable to damage from insects and moisture. By the 1070s, permanent wood foundations (PWF) gained acceptance.

Long-term durability is attainable with a sound wood foundation that is properly constructed. When wood foundations fail, the case is almost always due to poor construction techniques. Strength is achieved by following guidelines laid out in wood foundation manuals. The deeper into the ground, the stronger the wall needs to be. Choice of 2×6", 2×8" or 2×10" wall studs must be made correctly along with stud spacing and sheathing thickness. Ground pressure at the bottom of the foundation wall is resisted by the floor slab. Ground pressure at the top portion of the foundation wall is resisted because the foundation wall is anchored to the building floor system with hangers and clips. The intermediate ground pressure is resisted by proper selection of dimensioned wall studs, center-to-center stud proper spacing and outer sheathing thickness. Usually the sheathing is sealed with caulk and wrapped to cover the sheathing and header with an overlapping 6 mil polyethylene film and adhesively sealed to the sheathing and header. All water is typically filtered through the backfill, footings, and fill underneath the slab where the water is collected and pumped away by a sump pump or drained to the above ground if the building is built on a hill. Wood foundation costs are cheaper than concrete block or poured walls. Inside finishing is much easier and cheaper because you are finishing a stud wall.

Referring to prior art FIG. 1, the general construction of a permanent wood foundation wall 10 may be seen and understood. The permanent wood foundation 10 consists of treated wall studs 12 properly spaced and secured to treated footing plates 14 and a header plates 16. On the outside of the wall studs 12, exterior wall sheathing 18 is secured and sealed at its joints by moisture-proof caulking sealer. Lastly, a polyethylene 6-mil moisture barrier sheet or film 20 is placed over the foundation wall 10 to above ground covering the exposed foundation in an overlapping manor and adhesively sealed thereto. A plywood plank 30 protects the exposed poly film 20 above ground.

Below the footing plates 14 is a gravel base and footings 22 on top of which is placed a bottom polyurethane moisture barrier 24 that extends throughout the interior space of the foundation. Thereafter a floor slab 26 is poured and allowed to cure. Insulation 28 is placed or sprayed between the wood foundation wall studs 12 that consist of insulative materials which might be glass fiber, mineral wool, cellulose or sprayed polyurethane foam. A polyethylene moisture barrier film (not shown) is secured over the interior of the foundation wall studs 12. Drywall (not shown) is then secured to the inside of the wood foundation wall studs 12. Graded back fill 34 then fills in the exterior space on the outside of the foundation wall 10. Above ground floor joists 31 are supported by the foundation walls 10 upon which is secured floor panels 30 to complete floors 32. For purposes here, the first above ground floor 32 is supported by floor joists 31 which may be 2"×6", 2"×8", 2"×10" or 2"×12" depending upon the floor support requirements.

Concerning above the ground walls, Applicant's prior U.S. Pat. Nos. 9,677,264 and 9,783,985 thoroughly discuss and show prior building walls and their shortcomings. In these patents Applicant discloses and claims composite thermal break wood studs with rigid insulation, mechanical fasteners and wall framing systems.

SUMMARY OF THE INVENTION

A composite reinforced, optionally treated, wood stud for permanent wood foundations, above ground walls, floor joists, vertical support columns and headers for commercial and residential buildings has a first lumber section having a width and a depth and a second lumber section inverted with respect to the first lumber section having a width and a depth. A plurality of adjacent, aligned in a longitudinal row, mechanical fastening dowels angularly pass through the depth of the first lumber section and pass substantially through the width of the second lumber section. The dowels maintain a spatial relationship between the first and second lumber sections. The angularity of the dowels alternate vertically oppositely between adjacent dowels. From an end view, the dowels may alternate in a cant relationship with adjacent dowels in a left and right manner.

A principal object and advantage of the present invention is that the composite wall stud may dimensionally be made 5" to 12' deep or more. Width is contemplated to range from 2" to 4" wide. Top and bottom plates would be dimensioned to 2×6", 2×8", 2×10", 2×12", etc. The height ranges could be 8' to 24' tall.

Another object and advantage of the present invention is that by burrowing the dowels into the width W of the second lumber section, which is inverted to the first lumber section (90°), the composite wall stud has been incredibly stiffened because there is more dowel in the second lumber section hole increasing the surface area for adhesive securement. By way of example, a pencil held by the fingertips of both hand easily bends. If you hold the pencil with both hands, you cannot bend the pencil.

Another object and advantage of the present invention is that the composite reinforced stud having a dimension of 5½" deep is 1.5 times stronger than a 2"×6" traditional one piece all wood stud in all aspects including in floor applications.

Another object and advantage of the present invention is that the composite wall stud has incredible vertical or axial compression strength due the first and second lumber sections being inverted in relation to each other and the dowels are burrowed deeper into the second lumber section.

Another object and advantage of the present invention is that the composite wall stud can be used up to 24' tall.

Another object and advantage of the present invention is that the composite wall stud provides a 95.5% complete thermal break through the wall assembly if used with conventional 2"×6" lumber for top and bottom plates.

Another object and advantage of the present invention is that the composite wall stud has a R Value anywhere from 10.51 to 16.51 depending on insulation type used in the application.

Another object and advantage of the present invention is that the composite wall stud allows the builder to choose his own R Value by choosing what type of insulation is used to insulate the cavity between the composite wall studs.

Another object and advantage of the present invention is that the composite wall stud provides an increase in thermal efficiency through the framing members of 158% to 240%.

Another object and advantage of the present invention is that the composite wall stud will carry 3,660 pounds of axial load if used on a #2 spruce-pine-fur (spf) plate or up to 5,600 pounds if used with an laminated strand lumber (LSL) or laminated veneer lumber (LVL) plate.

Another object and advantage of the present invention is that the three-layer joined composite stud made into a column or header would be about 6"×6" and only cost about $6 a foot. The column or header 90 of the present invention would hold 1150 psi, with only 6 pieces of wood 2"×3" or 6"×1.5"×2.5"=22.5 sq in×1150 psi=25,875 pounds.

Another object and advantage of the present invention is that the composite wall stud can be used with 24" on center framing because of the structural gains due to the increase in axial compression strength.

Another object and advantage of the present invention is that the composite wall stud is that there is only a modest increase in building costs associated with purchase and use of the composite stud of $200 to $400 USD depending on shipping costs and retail markup (calculated based upon the North American US and Canadian Government statistics for basic one story house to be 2,450 square feet and has a 9' wall height).

Another object and advantage of the present invention, more specifically, is that the composite wall stud in the North American basic house will have only a $0.15 increase per square foot of floor space to gain a 13% increase in energy efficiency in the wall assembly amounting to only a $350 cost increase.

Another object and advantage of the present invention is that a dimensioned composite stud of #2 pine 2"×6" and 8' long without any insulation with 2,500 pounds of shear pressure along its middle length only deflects only ½" making the composite stud twice as shear resistant or stiff as a #2 pine 2"×6" and 8' long thereby having incredible shear strength along it length. This fact makes the composite stud ideal for wood found walls.

DETAILED SPECIFICATION

Figure 1:
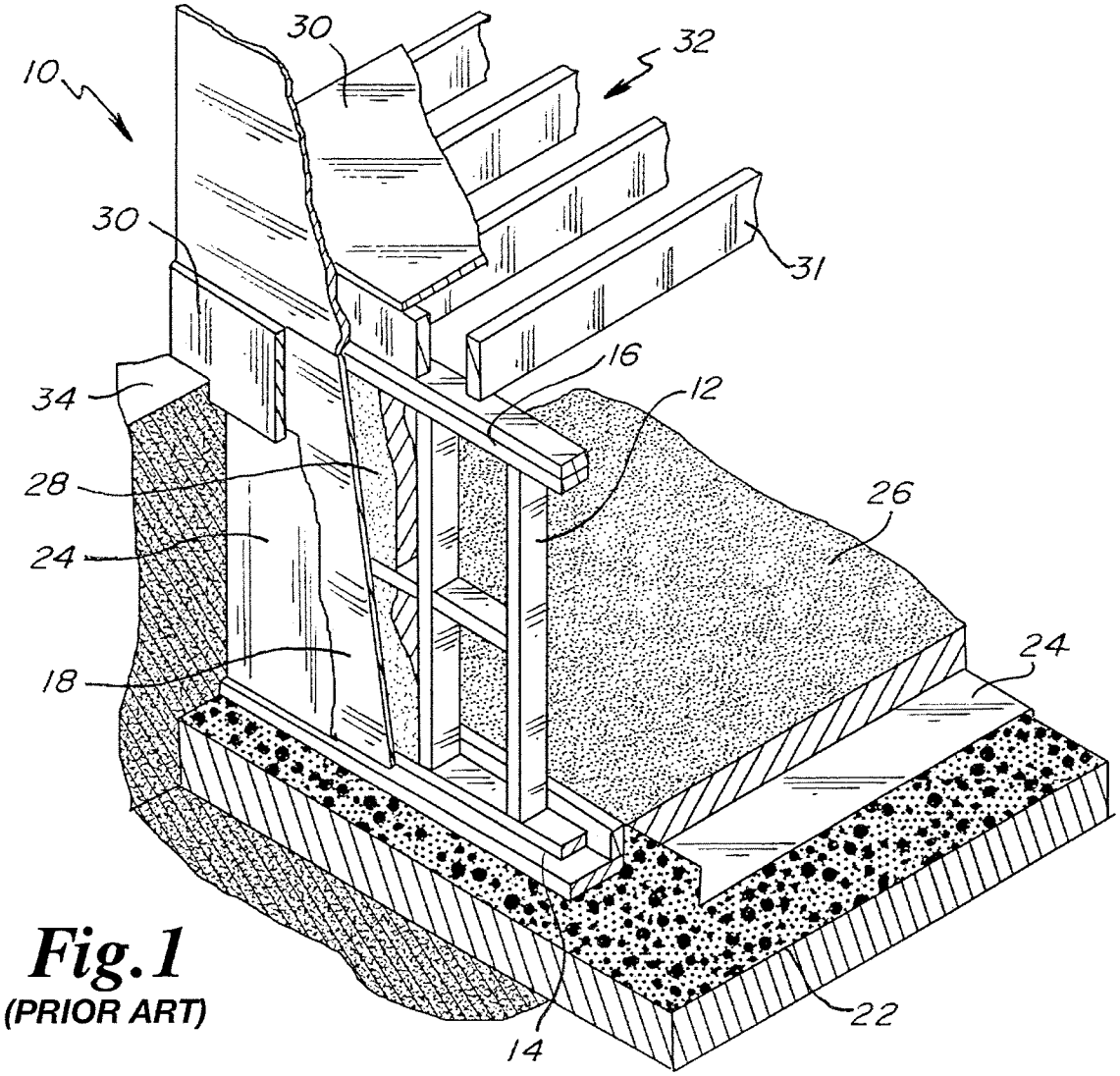
Fig. 1 (PRIOR ART)
FIG. 1 is a prior art broken away perspective view of a building with a permanent wood foundation and traditional above ground walls and a floor.

The composite reinforced, optionally treated, wood stud 50 of the present invention is used for permanent wood foundations 52, above ground walls 68, floor joists 82, vertical support columns or headers 90 and other undefined product replacements. Wood is defined as any wood or lumber product and any wood derivative composite product. Whereby the definition of "wood derivative" is defined as: a "New product that results from modifying an existing product, and which has different properties than those of the product it is derived from." Lumber, timber, wood, or wood derivative, includes any and all structural composite lumber products, such as laminated strand lumber, LSL, as it is commonly coined when ordering these products. This would include structural composite lumber (SCL), which includes laminated veneer lumber (LVL), parallel strand lumber (PSL), laminated strand lumber (LSL), finger-jointed lumber and oriented strand lumber (OSL). Nanocellulose materials, such as cellulose nanocrystals (CNC), would be included in this group. These composite lumbers are of a family of engineered wood products created by layering dried and graded wood veneers, strands or flakes with moisture resistant adhesive into blocks of material known as billets, which are subsequently re-sawn into specified sizes. In SCL billets, the grain of each layer of veneer or flakes runs primarily in the same direction. The resulting products out-perform conventional lumber when either face- or edge-loaded. SCL is a solid, highly predictable, and uniform engineered wood product that is sawn to consistent sizes and is virtually free from warping and splitting.

Figure 3:
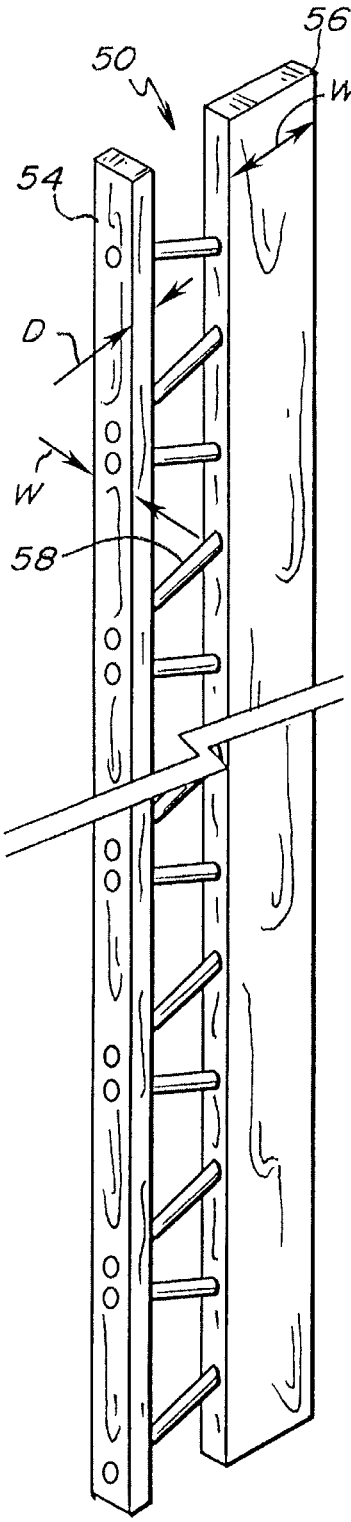
FIG. 3 is perspective view of the composite reinforced wood stud of the present invention.
Figure 2:
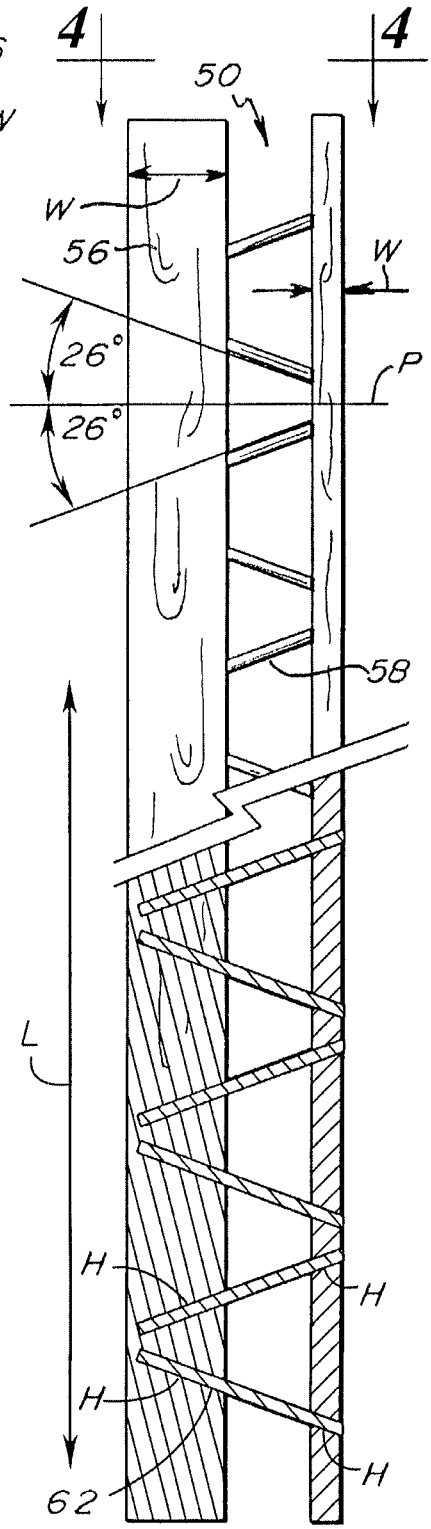
FIG. 2 is side elevationals view partially broken away of the composite reinforced wood stud.
Figure 4:
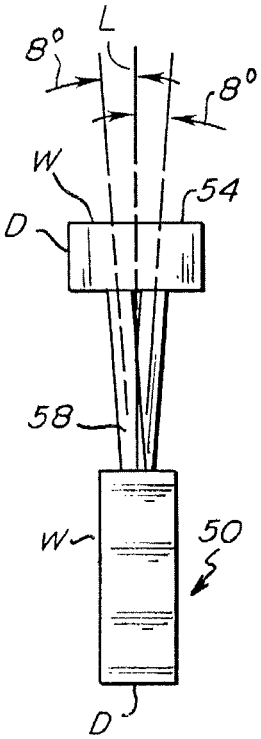
FIG. 4 is top plan or end view taken along lines 4-4 of FIG. 2 of the composite reinforced wood stud of the present invention.
Figure 5:
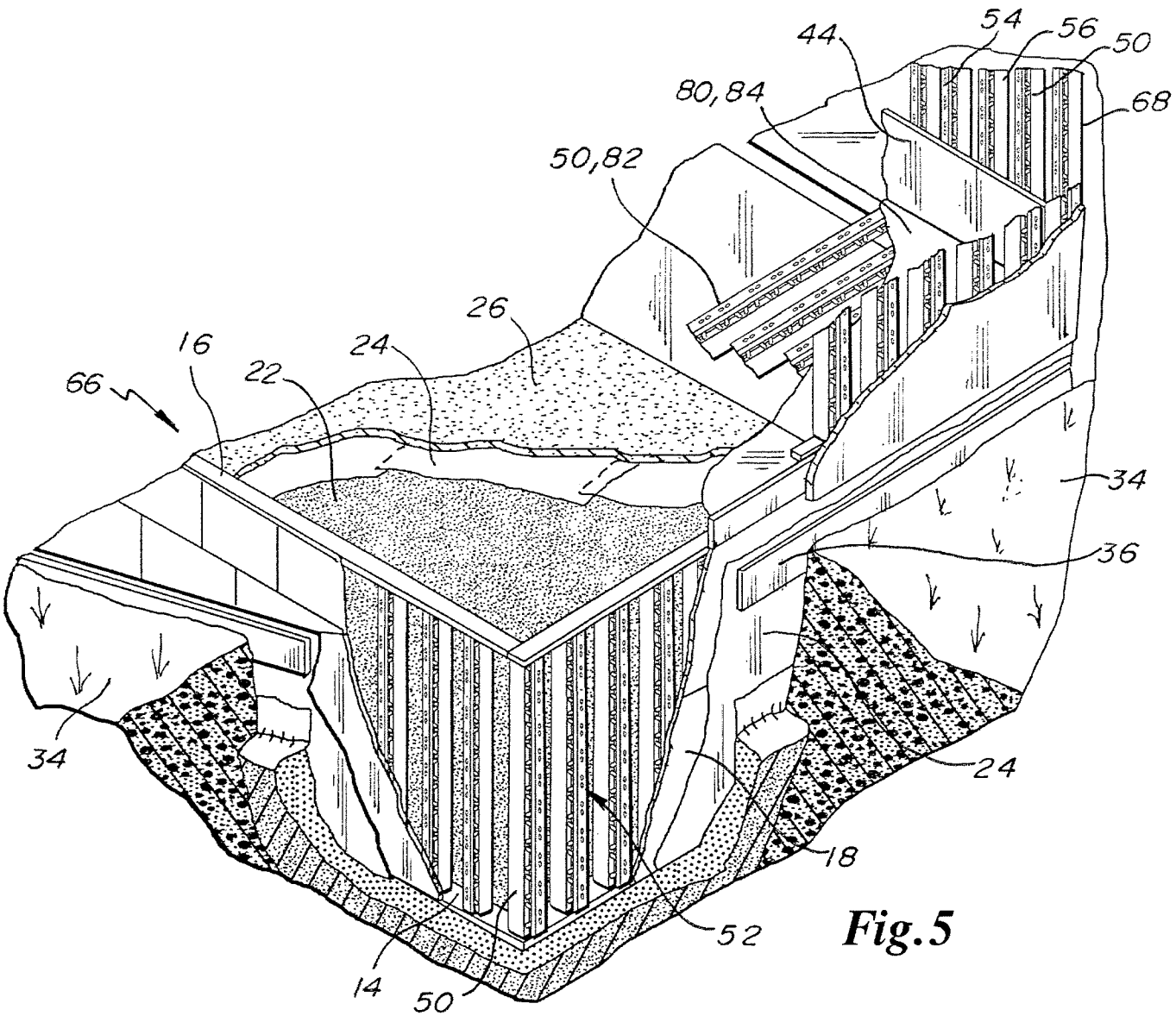
FIG. 5 is a broken away perspective view of a building with a permanent wood foundation walls, traditional above ground walls and a floor built with the composite wood stud of the present invention.
Figure 7:
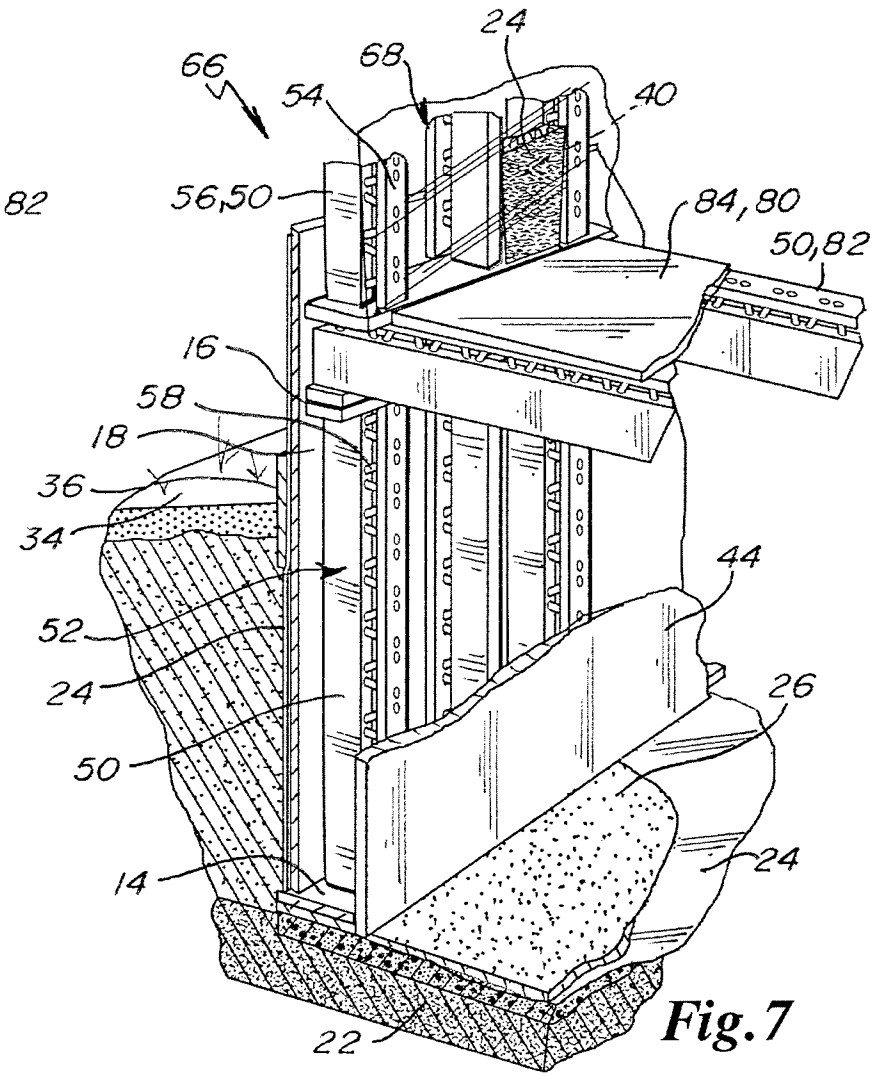
FIG. 7 is another detailed broken away perspective view of a more complete building foundation wall, floor and above ground wall of the present invention.
Figure 6:
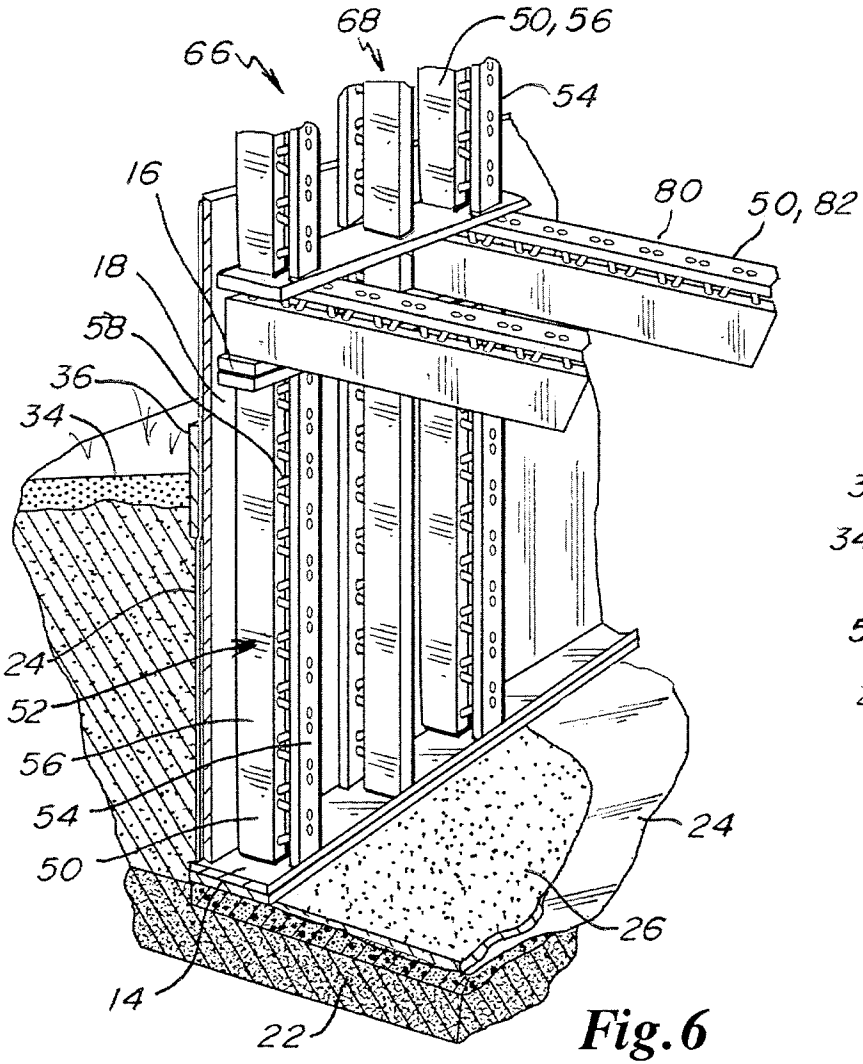
FIG. 6 is a detailed broken away perspective view of a building foundation wall, floor and above ground wall built with the composite wood stud of the present invention.
Figure 9:
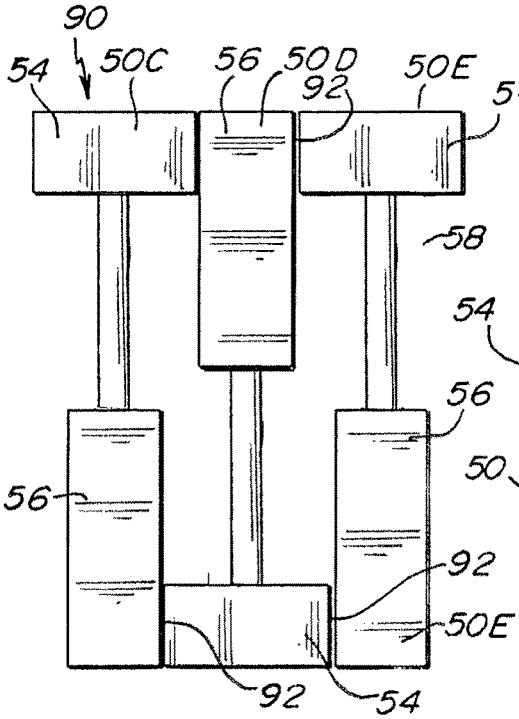
FIG. 9 is a top plan view of the composite wood studs used in vertical support columns and headers.

Referring to FIGS. 2-4, Applicant contemplates that the composite wood studs 50 of the present invention may dimensionally be made 5" to 12" and deeper. Width is contemplated to range from 2" to 4" wide and wider. The wood stud 50 includes a first lumber section 54 with a dimensional width W and a dimensional depth D. The wall stud 50 further includes a second lumber section 56 with a dimensional width W and a dimensional depth D. A plurality of alternating holes H pass through the depth D of the first lumber section 54 and through the width of the second lumber section 56 along the length arrow L of the wood stud 50 in alternately fashion. The holes are suitably at an angle of 26° within a range of 10° to 50° from a line P passing perpendicularly through both wood sections 54 and 56. From an end view, the holes maybe alternately canted left and right suitable at an angle of 8° within a range of 00 to 10° from a line L passing perpendicularly to a stud length through both wood sections 54 and 56. The hole H angles and cants alternate oppositely between adjacent holes H. FIG. 9 shows the dowels need not be canted at al.

The wall stud 50 includes mechanical fasteners 58 which are suitably wood dowels 58 (#2 pine) ideally 11/16" to 1½" to match holes H. For smaller wall studs 50, the holes H are ideally ⅜". The dowels 58 are run through an abrader device to create a helical outer grooved surface 60 which aids in retaining glue 62 on the outer surface of dowels 58. The assembly the composite wood stud 50 includes the step of wood glue 62 being coated on the inside surfaces of the angled holes H. Wood glues 62 choices might include polymethylene polyphenyl isocyanate or penta-NA diethylenetriamine pentaacetate obtainable from Ashland of Columbus, Ohio under the trademark Isoset™. Next, the dowels 180 are then pounded into and through the first lumber section 54 holes H and substantially into the second lumber section 56 holes H. Thereafter, sawing, sanding or grinding will make the dowels 58 flush with the wood section 54. Dowels 58 can also suitably be made of plastic, wood composite or man-made materials. By burrowing the dowels 58 deep into the width W of the second lumber section 56, there is more affective surface area for adhesive along the dowels 58, and thereby, the composite wood stud 50 has been incredibly stiffened.

The composite reinforced treated wood stud 50 may be used to construct a permanent composite reinforced, treated or not treated, wood foundation walls 52, exterior above ground, treated or not, wood walls. 68, floors 80 and vertical support columns and headers 90.

Referring to FIGS. 5-8, the composite wall stud 50 in a detailed permanent wood foundation wall 52 in a building 66 both underground and above ground may be seen and understood. The composite reinforced treated wood stud 50 includes, as described above, the first lumber section 54 with its dimensional width W and its dimensional depth D and the second lumber section 56 with its dimensional width W and its dimensional depth D. A plurality of alternating holes H pass through the depth D of the first lumber section 54 and through the width W of the second lumber section 56 along the length arrow L of the wood stud 50 in alternating fashion. The wall stud 50 includes alternating angular adjacent mechanical fasteners 58 that are suitably wood dowels 58 that are glued into holes H.

Building 66 has a permanent wood foundation walls 52 made out of composite wood studs 50. The first lumber section 54 may be oriented inwardly or outwardly (as seen in FIGS. 5-8) depending on the desired application and surface area needs where the most screw or nail surface area is desired. The composite reinforced wood studs 50 are fastened at their bottoms to footer plates 14 and at their top to header plates 16. Advisably, plates 14 and 16 suitably should be #2 MSR1650, LSL or LVL members for all applications. The studs 50 are spaced vertically center-to-enter 24" apart. Exterior treated wall sheathing 18 is mounded to the outside of the foundation walls 52. Exterior insulation may be added at this point if desired or required by ordinance. Six-mil poly film 24 is then wrapped to cover in overlapping fashion the exterior sheathing 18 (and insulation if present) header and glued thereat.

Determining the center-to-center vertical wall stud 50, made with 2"×3" lumber sections 54 and 56, the spacing is dependent upon how deep the wood foundation wall 52 is into the ground and the type of soil, back fill material and water gradients around the building 66. Additionally, the ability of the composite stud 50 to hold an axial compression loads without crushing the header or footing plates 14 and 16 is important to consider. The plates 14 and 16 can hold roughly 3,300 pounds of load without crushing a #2 spruce, pine or fur material; or 5,600 pounds if the plate material is made from LSL or LVL. If the building 66 is 3 stories in height and is in a snow load area, the loads on the top floor may be 1,000 pounds per foot of wall just to hold up the roof. But the second floor will have to hold up the third floor and the roof load, so 2,000 pound per foot load is to be considered. So the top floor could have be 24" on center and the middle floor could be at 16" on center, and the bottom floor (foundation floor walls 52) could be at 12" on center, just based on crushing the plates. One has to know the loads of every floor and roof in order to calculate spacing and materials to be used. The composite stud 50 is able to hold up to 8,600 pounds per foot load if the composite wood stud 50 is placed on steel or concrete plates 14 and 16. So the most the composite stud 50 can hold is based on the ability of the header and footing plates 14 and 16 to not crush. This is why LSL or LVL material plates 14 and 16 are recommended. It the composite wood stud 50 is made with 2"×4" lumber sections 54 and 56, the composite wood stud 50 would be able to hold up to 12,000 pounds per foot load.

Building 66 is built on a gravel base or concrete footing 22 over which is covered with 6-mil polyurethane sheeting or film 24. After the foundation walls 52 are built, then the basement floor slab 26 is poured with in the basement space bounded by the permanent wood foundation walls 52. The basement floor slab 26 holds the bottom portions of the permanent wood foundation walls 52 from moving inward under the force of the back fill 34 and water. The plywood strip or plank 36 is attached to protect the poly film 36 above ground. Graded back till 34 and top soil is then moved into place. Interior insulation 40 may be placed or blown in place between foundation wall 52 composite studs 50. Afterwhich, another 6-mil poly moisture barrier film 24 is secured to studs 50. The sheet rock 44 may next be fastened to the interior of the foundation wall 52.

Building 66 also has a permanent exterior above ground walls 68 made from treated or untreated composite reinforced wood studs 50 that include, as described above, the first lumber section 54 with its dimensional width W and its dimensional depth D and the second lumber section 56 with its dimensional width W and its dimensional depth D. A plurality of alternating holes H pass through the depth D of the first lumber section 54 and through the width W of the second lumber section 56 along the length arrow L of the wood stud 50 in alternating fashion. The wall composite studs 50 of exterior above ground walls 68 includes angular adjacent mechanical fasteners or dowels 58 that are pounded into and glued into holes H. The composite wood studs 50 are fastened at their bottoms to footer plates 14 and at their top to header plates 16. The studs 50 are spaced vertically center-to-enter 24" apart. Exterior treated wall sheathing 72 is mounded to the outside of the exterior wall 68. Exterior insulation may be added at this point if desired or required by ordinance. Six-mil poly film 76 is then wrapped to cover in overlapping fashion the exterior sheathing 72 (and insulation if present), header and glued thereat. Interior insulation 40 may be placed or blown in place between foundation wall 52 composite studs 50. Afterwhich, another 6-mil poly moisture barrier film 24 is secured to the interior side of composite studs 50 and the sheet rock 44 may next be fastened to the interior of the above ground exterior wall 68.

Building 66 also has interior above ground floors 80 made from treated or untreated composite reinforced wood studs 50 that include, as described above, the first lumber section 54 with its dimensional width W and its dimensional depth D and the second lumber section 56 with its dimensional width W and its dimensional depth D. A plurality of alternating holes H pass through the depth D of the first lumber section 54 and through the width W of the second lumber section 56 along the length arrow L of the wood stud 50 in alternating fashion. The widest portion of wood studs 50 is first lumber section 54. The first lumber section 54 may be oriented up or down depending on the desired application and where the most screw or nail surface area is desired. Wood studs 50 are used as floor joists 82 that support floor boards 84 from below. The composite studs 50 for floors 80 are spaced horizontally center-to-enter 24" apart.

Figure 8:
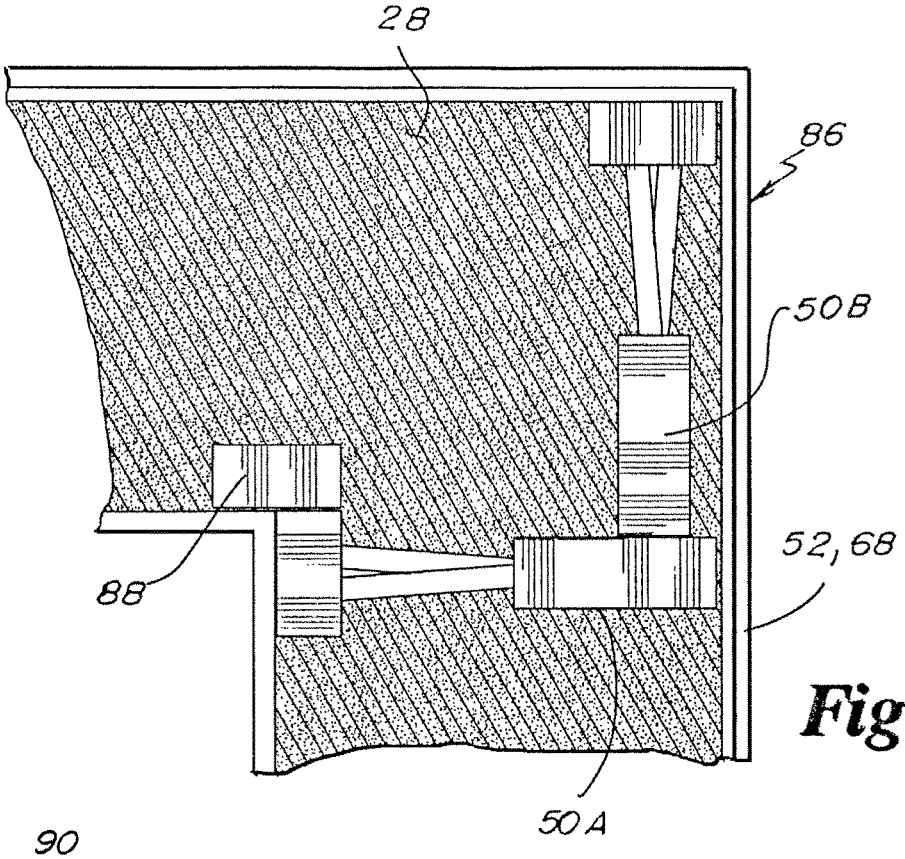
FIG. 8 is a top plan view of a corner section broken away of a foundation wall or above ground wall of the present invention.

Referring to FIG. 8, a corner wall section 86 may be constructed accordingly for a permanent wood foundation wall 52 or an above ground wall 68. The corner wall section 86 has a first composite stud 50A oriented through the wall 52 or 68. A second composited stud 50B is oriented along the outer portion of wall 52 or 68 in an abutting relation to composite stud 50A to complete the outer portion of corner wall section 86. A standard 2"×4" board 88 abuts against the first composite stud 50A to complete the inner portion of the corner wall section 86.

Figure 10:
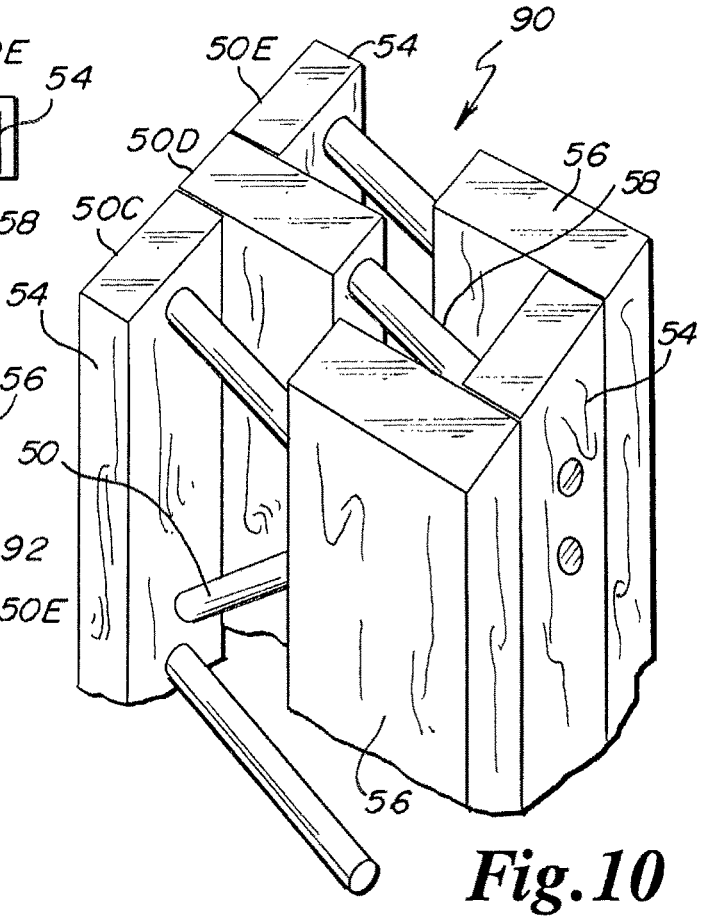
FIG. 10 is a perspective view of a column or header of FIG. 9.
Figure 11:
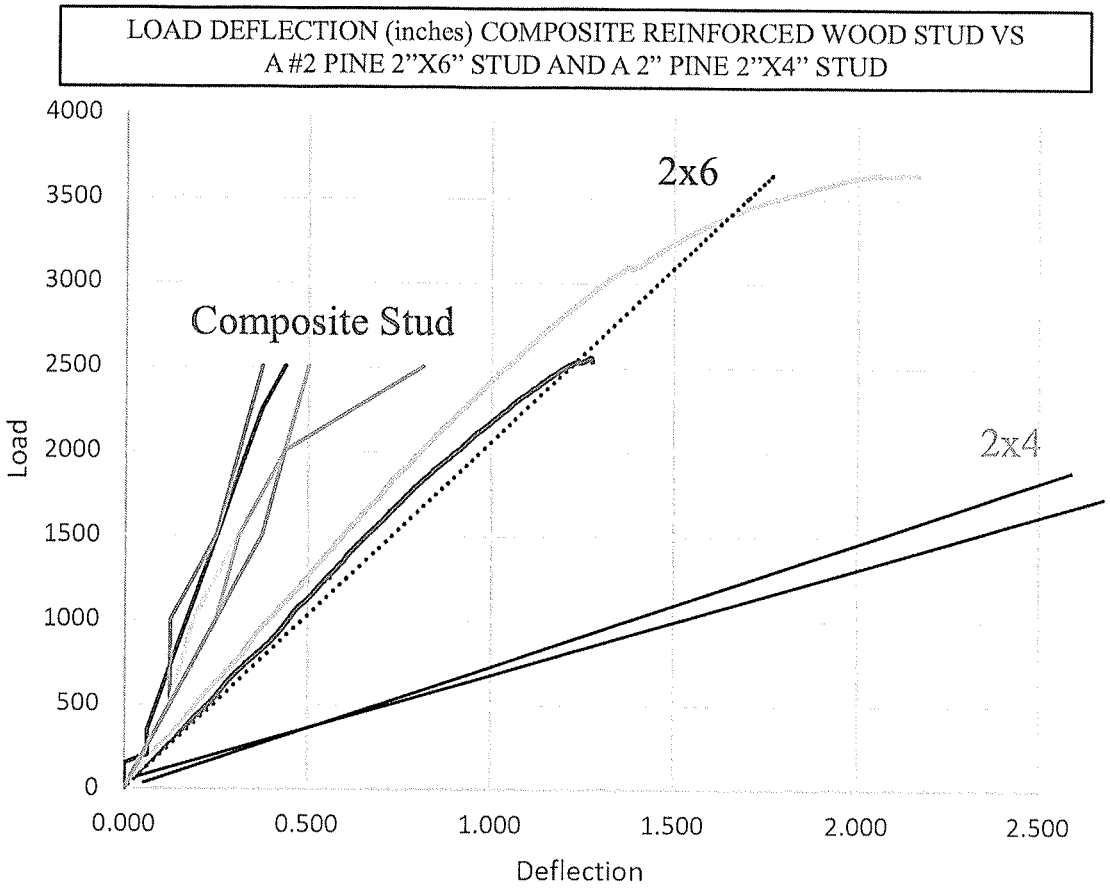
FIG. 11 is a table showing results for the composite stud 50 were done without any insulation in the composite stud 50 for horizon shear testing.

Referring to FIGS. 9 and 10, a vertical support column or header 90 may be seen. Column 90 is made with composite reinforced wood studs 50 that may be treated or untreated. Composite reinforced wood studs 50, as described above, the first lumber section 54 with its dimensional width W and its dimensional depth D and the second lumber section 56 with its dimensional width W and its dimensional depth D. A plurality of alternating holes H pass through the depth D of the first lumber section 54 and through the width W of the second lumber section 56 along the length arrow L of the wood stud 50 in alternating fashion. The wall composite studs 50 of exterior above ground walls 68 includes angular adjacent mechanical fasteners or dowels 58 that are pounded into and glued into holes H. Vertical support column or header 90 includes composite studs 50C, 50D and 50D. additional composite studs 50 may be used depending on the application. The composite studs 50C, 50D and 50D may be nailed, screwed and or glued together.

The closest competitor to this composite wood stud vertical column or header 90 is a PSL parallel strand lumber (PSL) column. A 6"×6" PSL column costs $18.88 a foot today and the three-layer joined composite stud made into a column or header 90 would be about the same size and run about $6 a foot. The PSL column can hold a lot of weight, about 2000 psi (pounds per square inch). But a PSL column has 5.25"×5.25"=29.1 sq inches of area×2000 psi=58,000 pounds of vertical support. The column or header 90 of the present invention would hold 1150 psi, with only 6 pieces of wood 2"×3" or 6"×1.5"×2.5"=22.5 sq in×1150 psi=25,875 pounds.

Energy efficiencies are achieved by using the composite reinforced treated, or untreated, wood stud 50 as shown in Table 2 below:

TABLE 2

INCREASE ENERGY EFFICIENCY OF THE FRAMING MEMBER

| | R VALUE | PERCENTAGE |
|---|---|---|
| 2 × 4 | 4.375 | 65% |
| 2 × 6 - "THE STANDARD" | 6.88 | 100% |
| COMPOSITE REINFORCED WOOD STUD WITH CELLULOSE | 10.85 | 158% |
| COMPOSITE REINFORCED WOOD STUD WITH FIBERGLASS | 11.35 | 165% |
| COMPOSITE REINFORCED WOOD STUD WITH SPRAY FOAM | 16.51 | 240% |

Lineal feet of standard 2"×6" studs are saved when using the composite wood stud 50 according to Table 3 below:

TABLE 3

LINEAL FEET SAVED IN AN AVERAGE HOUSE

| | |
|---|---|
| 1682 | Lineal Feet of 2 × 6 |
| 1121 | Lineal Feet of Composite Reinforced Wood Stud |
| 561 | Lineal Feet Saved |
| 33% | Less Framing Members |

The above embodiments are for illustrative purposes and the scope of this invention is described in the appended claims.

What is claimed:

1. A composite reinforced wood stud for use in permanent wood foundations walls, above ground exterior walls, floor joists, vertical support columns or headers for commercial and residential buildings, comprising:

a.) a first lumber section having a first width and a first depth and a second lumber section inverted with respect to the first lumber section having a second width and a second depth;

b.) a plurality of adjacent mechanical fastening dowels angularly passing through the first depth of the first lumber section and passing substantially through the second width of the second lumber section while maintaining a spatial relationship between the first and second lumber sections, the angularity of the dowels alternating oppositely between adjacent dowels; and c.) wherein the first width of the first lumber section is greater than the second depth of the second lumber section.

2. The composite reinforced wood stud of claim 1 wherein the alternating angularity of the adjacent dowels range from 10° to 50° from a line passing perpendicularly through both lumber sections.

3. The composite reinforced wood stud of claim 2 wherein the alternating angularity of the adjacent dowels is 26° from a line passing perpendicularly through both lumber sections.

4. The composite reinforced wood stud of claim 2 wherein from an end view the adjacent dowels alternately oppositely in a canted relationship from 0° to 10° from left to right of the perpendicular line.

5. The composite reinforced wood stud of claim 2 wherein from an end view the adjacent dowels alternately oppositely in a canted relationship 8° from left to right of the perpendicular line.

6. The composite reinforced wood stud of claim 1 wherein the dowels are made of wood in a range of 11/16" to 1½" in diameter.

7. The composite reinforced wood stud of claim 1 wherein the dowels have an abraded helical outer grooved surface and are glued in the first and second lumber sections.

8. The composite reinforced wood stud of claim 1 wherein the dowels range from 5" to 12" deep and 2" to 4" wide and up to 24' in length.

9. A composite reinforced wood stud permanent wood foundation wall for commercial and residential buildings, comprising:

a.) a composite reinforced treated wood studs, each comprising:

i.) a first lumber section having a first width and a first depth and a second lumber section inverted with respect to the first lumber section having a second width and a second depth with an inner and an outer side, ii.) a plurality of adjacent mechanical fastening dowels angularly passing through the first depth of the first lumber section and passing substantially through the second width of the second lumber section while maintaining a spatial relationship between the first and second lumber sections, the angularity of the dowels alternating oppositely between adjacent dowels, and iii.) wherein the first width of the first lumber section is greater than the second depth of the second lumber section;

b.) header and footer plates between the composite reinforced wood studs which may be placed 24" on center from each other;

c.) treated outer sheathing on mounted to the outside of the composite wood studs;

d.) an exterior moisture barrier placed on the treated outer sheathing;

e.) insulation between the composite wood studs; and f.) an interior moisture barrier placed over the insulation and composite wood studs.

10. The composite reinforced wood stud of claim 9 wherein the alternating angularity of the adjacent dowels range from 10° to 50° from a line passing perpendicularly through both lumber sections.

11. The composite reinforced wood stud of claim 9 wherein the alternating angularity of the adjacent dowels is 26° from a line passing perpendicularly through both lumber sections.

12. The composite reinforced wood stud of claim 9 wherein from an end view the adjacent dowels alternately oppositely in a canted relationship from 0° to 10° from left to right of the perpendicular line.

13. The composite reinforced wood stud of claim 9 wherein from an end view the adjacent dowels alternately oppositely in a canted relationship 8° from left to right of the perpendicular line.

14. The composite reinforced wood stud of claim 9 wherein the dowels are made of wood in a range of 11/16" to 1½" in diameter.

15. The composite reinforced wood stud of claim 9 wherein the dowels have an abraded helical outer grooved surface and are glued into first and second lumber sections.

16. The composite reinforced wood stud of claim 9 wherein the dowels range from 5" to 12" deep and 2" to 4" wide and up to 24' in length.

17. A composite reinforced wood stud exterior above ground wall for commercial and residential buildings, comprising:

a.) a composite reinforced wood studs, each comprising:

i.) a first lumber section having a first width and a first depth and a second lumber section inverted with respect to the first lumber section having a second width and a second depth with an inner and an outer side, ii.) a plurality of adjacent mechanical fastening dowels angularly passing through the first depth of the first lumber section and passing substantially through the second width of the second lumber section while maintaining a spatial relationship between the first and second lumber sections, the angularity of the dowels alternating oppositely between adjacent dowels, and iii.) wherein the first width of the first lumber section is greater than the second depth of the second lumber section;

b.) header and footer plates between the composite reinforced wood studs which may be placed 24" on center from each other;

c.) treated outer sheathing on mounted to the outside of the composite wood studs;

d.) an exterior moisture barrier placed on the treated outer sheathing;

e.) insulation between the composite wood studs; and f.) an interior moisture barrier placed over the insulation and composite wood studs.

18. The composite reinforced wood stud of claim 17 wherein the alternating angularity of the adjacent dowels range from 10° to 50° from a line passing perpendicularly through both lumber sections.

19. The composite reinforced wood stud of claim 17 wherein the alternating angularity of the adjacent dowels is 26° from a line passing perpendicularly through both lumber sections.

20. The composite reinforced wood stud of claim 17 wherein from an end view the adjacent dowels alternately oppositely in a canted relationship from 0° to 10° from left to right of the perpendicular line.

21. The composite reinforced wood stud of claim 17 wherein from an end view the adjacent dowels alternately oppositely in a canted relationship 8° from left to right of the perpendicular line.

22. The composite reinforced wood stud of claim 17 wherein the dowels are made of wood in a range of 11/16" to 1½" in diameter.

23. The composite reinforced wood stud of claim 17 wherein the dowels have an abraded helical outer grooved surface and are glued in the first and second lumber sections.

24. The composite reinforced wood stud of claim 17 wherein the dowels range from 5" to 12" deep and 2" to 4" wide and up to 24' in length.

25. A composite reinforced wood stud floor for commercial and residential buildings, comprising:

a.) composite reinforced wood stud floor joists, each comprising:

i.) a first lumber section having a first width and a first depth and a second lumber section inverted with respect to the first lumber section having a second width and a second depth with an inner and an outer side, ii.) a plurality of adjacent mechanical fastening dowels angularly passing through the first depth of the first lumber section and passing substantially through the second width of the second lumber section while maintaining a spatial relationship between the first and second lumber sections, the angularity of the dowels alternating oppositely between adjacent dowels, and iii.) wherein the first width of the first lumber section is greater than the second depth of the second lumber section;

b.) wood panels mounted on top of the wood stud joists.

26. The composite reinforced wood stud of claim 25 wherein the alternating angularity of the adjacent dowels range from 10° to 50° from a line passing perpendicularly through both lumber sections.

27. The composite reinforced wood stud of claim 25 wherein the alternating angularity of the adjacent dowels is 26° from a line passing perpendicularly through both lumber sections.

28. The composite reinforced wood stud of claim 25 wherein from an end view the adjacent dowels alternately oppositely in a canted relationship from 0° to 10° from left to right of the perpendicular line.

29. The composite reinforced wood stud of claim 25 wherein from an end view the adjacent dowels alternately oppositely in a canted relationship 8° from left to right of the perpendicular line.

30. The composite reinforced wood stud of claim 25 wherein the dowels are made of wood in a range of 11/16" to 1½" in diameter.

31. The composite reinforced wood stud of claim 25 wherein the dowels have an abraded helical outer grooved surface and are glued in first and second lumber sections.

32. The composite reinforced wood stud of claim 27 wherein the dowels range from 5" to 12" deep and 2" to 4" wide and up to 24' in length.

33. A composite reinforced wood stud column or header for commercial and residential buildings, comprising:

a.) at least three composite reinforced wood studs, comprising:

i.) a first lumber section having a first width and a first depth and a second lumber section inverted with respect to the first lumber section having a second width and a second depth with an inner and an outer side, ii.) a plurality of adjacent mechanical fastening dowels angularly passing through the first depth of the first lumber section and passing substantially through the second width of the second lumber section while maintaining a spatial relationship between the first and second lumber sections, the angularity of the dowels alternating oppositely between adjacent dowels, and iii.) wherein the first width of the first lumber section is greater than the second depth of the second lumber section;

wherein the at least three composite reinforce wood studs are fastened together in alternating 180° arrangement.

34. The composite reinforced wood stud of claim 33 wherein the alternating angularity of the adjacent dowels range from 10° to 50° from a line passing perpendicularly through both lumber sections.

35. The composite reinforced wood stud of claim 33 wherein the alternating angularity of the adjacent dowels is 26° from a line passing perpendicularly through both lumber sections.

36. The composite reinforced wood stud of claim 33 wherein from an end view the adjacent dowels alternately oppositely in a canted relationship from 0° to 10° from left to right of the perpendicular line.

37. The composite reinforced wood stud of claim 33 wherein from an end view the adjacent dowels alternately oppositely in a canted relationship 8° from left to right of the perpendicular line.

38. The composite reinforced wood stud of claim 33 wherein the dowels are made of wood in a range of 11/16" to 1½" in diameter.

39. The composite reinforced wood stud of claim 33 wherein the dowels have an abraded helical outer grooved surface and are glued in the first and second lumber sections.

40. The composite reinforced wood stud of claim 33 wherein the dowels range from 5" to 12" deep and 2" to 4" wide and up to 24' in length.

* * * * *